US006087311A

United States Patent [19]

Van Dijk

[11] Patent Number: 6,087,311

[45] Date of Patent: Jul. 11, 2000

[54] COATED DETERGENT TABLET

[75] Inventor: Paul Irma Albertus Van Dijk, Putte, Belgium

[73] Assignee: The Proctor & Gamble Company, Cincinnati, Ohio

[21] Appl. No.: 09/319,473

[22] PCT Filed: Nov. 19, 1997

[86] PCT No.: PCT/US97/21042

§ 371 Date: Jun. 4, 1999

§ 102(e) Date: Jun. 4, 1999

[87] PCT Pub. No.: WO98/24874

PCT Pub. Date: Jun. 11, 1998

[30] Foreign Application Priority Data

Dec. 6, 1996 [EP] European Pat. Off. ..... 96203464

[51] Int. Cl.[7] ..... C11D 3/20; C11D 11/00; C11D 17/00

[52] U.S. Cl. ..... 510/294; 510/298; 510/361; 510/441; 510/442; 510/446; 510/470; 510/477; 510/488; 510/491

[58] Field of Search ..... 510/294, 298, 510/361, 441, 442, 446, 477, 488, 470, 491

[56] References Cited

U.S. PATENT DOCUMENTS

| | | | |
|---|---|---|---|
| 3,324,038 | 6/1967 | Chaffee et al. | 252/152 |
| 3,506,756 | 4/1970 | Hoss | 424/44 |
| 4,576,727 | 3/1986 | Browne | 252/90 |
| 5,133,892 | 7/1992 | Chun et al. | 252/90 |

FOREIGN PATENT DOCUMENTS

| | | | |
|---|---|---|---|
| 62-225600 | 10/1987 | Japan | C11D 10/02 |

*Primary Examiner*—Lorna M. Douyon
*Attorney, Agent, or Firm*—C. Brant Cook; Kim William Zerby; Jacobus C. Rasser

[57] ABSTRACT

Tablets comprise a core and a coating, the core being formed by compressing a particulate material, the particulate material comprising surfactant and detergent builder, and the coating comprising dicarboxylic acid. The tablets are provided with effervescent agents, in the core or water-swellable desintegrant in the coating which aid in their disintegration in wash liquors. The invention also relates to processes for making the tablets.

6 Claims, No Drawings

COATED DETERGENT TABLET

The present invention relates to coated detergent tablets, especially those adapted for use in washing machines, and to processes for making the coated detergent tablets.

Although cleaning compositions in tablet form have often been proposed, these have not (with the exception of soap bars for personal washing) gained any substantial success, despite the several advantages of products in a unit dispensing form. One of the reasons for this may be that detergent tablets require a relatively complex manufacturing process. In particular, it is often desirable to provide the tablet with a coating and this adds to the difficulties of manufacture.

While tablets without a coating are entirely effective in use, they usually lack the necessary surface hardness to withstand the abrasion that is a part of normal manufacture, packaging and handling. The result is that uncoated tablets suffer from abrasion during these processes, resulting in chipped tablets and loss of active material.

Finally, coating of tablets is often desired for aesthetic reasons, to improve the outer appearance of the tablet or to achieve some particular aesthetic effect.

Numerous methods of tablet coating have been proposed, and many of these have been suggested for detergent tablets. However, all of these methods have certain disadvantages, as will be explained below.

GB-A-0 989 683, published on Apr. 22, 1965, discloses a process for preparing a particulate detergent from surfactants and inorganic salts; spraying on water-soluble silicate; and pressing the detergent particles into a solid form-retaining tablet. Finally a readily water-soluble organic film-forming polymer (for example, polyvinyl alcohol) provides a coating to make the detergent tablet resistant to abrasion and accidental breakage.

EP-A-0 002 293, published on Jun. 13, 1979, discloses a tablet coating comprising hydrated salt such as acetate, metaborate, orthophosphate, tartrate, and sulphate.

EP-A-0 716 144, published on Jun. 12, 1996, also discloses laundry detergent tablets with water-soluble coatings which may be organic polymers including acrylic/maleic co-polymer, polyethylene glycol, PVPVA, and sugar.

WO9518215, published on Jul. 6, 1995, provides water-insoluble coatings for solid cast tablets. The tablets are provided with hydrophobic coatings including wax, fatty acid, fatty acid amides, and polyethylene glycol.

None of the prior art discloses the use of dicarboxylic acid coating materials for tablets that have a soft core prepared by compression of particulate materials.

The present invention provides a means by which tablets with a core which is formed by compressing a particulate material, the particulate material comprising surfactant and detergent builder, can be provided with a hard, thin, coating so that they can be stored, shipped and handled, but the coating is broken when the tablet is in the washing machine exposing the soft core which breaks up easily and rapidly, releasing the active ingredients into the wash solution.

The object of the present invention is to provide a tablet which completely disintegrates and disperses in alkaline or surfactant-rich solutions such as the wash liquor.

SUMMARY OF THE INVENTION

The object of the invention is achieved by providing a coating comprising a dicarboxylic acid, preferably wherein the length of the carbon chain of the dicarboxylic acid is from C2 to C13.

In one embodiment of the invention the coating consists essentially of dicarboxylic acid.

In a further aspect of the invention there is provided a process for making a tablet comprising the steps of:

(a) forming a core by compressing a particulate material, the particulate material comprising surfactant and detergent builder;

(b) applying a coating material to the core, the coating material being in the form of a melt;

(c) allowing the molten coating material to solidify;

wherein the coating material comprises dicarboxylic acid.

In an alternative to this embodiment of the invention there is provided a process for making a tablet comprising the steps of:

(a) forming a core by compressing a particulate material, the particulate material comprising surfactant and detergent builder;

(b) applying a coating material to the core, the coating material being dissolved in a solvent or water;

(c) allowing the solvent or water to evaporate;

wherein the coating material comprises dicarboxylic acid.

DETAILED DESCRIPTION OF THE INVENTION

Tablets to be coated in the present invention can be prepared simply by mixing the solid ingredients together and compressing the mixture in a conventional tablet press as used, for example, in the pharmaceutical industry. Any liquid ingredients, for example the surfactant or suds suppressor, can be incorporated in a conventional manner into the solid particulate ingredients. Preferably the principal ingredients, are used in particulate form.

In particular for laundry tablets, the ingredients such as builder and surfactant can be spray-dried in a conventional manner and then compacted at a suitable pressure.

The detergent tablets can be made in any size or shape and can, if desired, be surface treated before coating, according to the present invention. In the core of the tablet is included a surfactant and a builder which normally provides a substantial part of the cleaning power of the tablet. The term "builder" is intended to mean all materials which tend to remove calcium ion from solution, either by ion exchange, complexation, sequestration or precipitation.

The particulate material used for making the tablet of this invention can be made by any particulation or granulation process. An example of such a process is spray drying (in a co-current or counter current spray drying tower) which typically gives low bulk densities 600 g/1 or lower. Particulate materials of higher density can be prepared by granulation and densification in a high shear batch mixer/granulator or by a continuous granulation and densification process (e.g. using Lodige® CB and/or Lodige® KM mixers). Other suitable processes include fluid bed processes, compaction processes (e.g. roll compaction), extrusion, as well as any particulate material made by any chemical process like flocculation, crystallisation sentering, etc. Individual particles can also be any other particle, granule, sphere or grain.

The particulate materials may be mixed together by any conventional means. Batch is suitable in, for example, a concrete mixer, Nauta mixer, ribbon mixer or any other. Alternatively the mixing process may be carried out continuously by metering each component by weight on to a moving belt, and blending them in one or more drum(s) or mixer(s). A liquid spray-on to the mix of particulate materials (e.g. non-ionic surfactants) may be carried out. Other liquid ingredients may also be sprayed on to the mix of particulate materials either separately or premixed. For example perfume and slurries of optical brighteners may be sprayed. A finely divided flow aid (dusting agent such as zeolites, carbonates, silicas) can be added to the particulate materials after spraying the non-ionic, preferably towards the end of the process, to make the mix less sticky.

The tablets may be manufactured by using any compacting process, such as tabletting, briquetting, or extrusion, preferably tabletting. Suitable equipment includes a standard single stroke or a rotary press (such as Courtoy®, Korch®, Manesty®, or Bonals®). The tablets prepared according to this invention preferably have a diameter of between 40 mm and 50 mm, and a weight between 25 and 60 g. The compaction pressure used for preparing these tablets need not exceed 5000 $kN/m^2$, preferably not exceed 3000 $kN/m^2$, and most preferably not exceed 1000 $kN/m^2$.

According to the present invention, the tablets are then coated with dicarboxylic acid so that the tablet does not absorb moisture, or absorbs moisture at only a very slow rate. The coating is also strong so that moderate mechanical shocks to which the tablets are subjected during handling, packing and shipping result in no more than very low levels of breakage or attrition. Finally the coating is preferably brittle so that the tablet breaks up when subjected to stronger mechanical shock. Furthermore it is advantageous if the coating material is dissolved under alkaline conditions, or is readily emulsified by surfactants. This avoids the deposition of undissolved particles or lumps of coating material on the laundry load. This may be important when the more water-insoluble dicarboxylic acids are used.

Water solubility is measured following the test protocol of ASTM E1148-87 entitled. "Standard Test Method for Measurements of Aqueous Solubility".

Suitable coating materials are C2–C 13 dicarboxylic acids. Particularly suitable dicarboxylic acids are selected from the group consisting of oxalic acid, malonic acid, succinic acid, glutaric acid, adipic acid, pimelic acid, suberic acid, azelaic acid, sebacic acid, undecanedioic acid, dodecanedioic acid, tridecanedioic acid and mixtures thereof.

However the detergent tablets are prepared and in whatever from they are, they are then coated according to the present invention with a coating material having a melting point preferably of from 40° C. to 200° C.

The coating can be applied in a number of ways. Two preferred coating methods are a) coating with a molten material and b) coating with a solution of the material.

In a), the coating material is applied at a temperature above its melting point, and solidifies on the tablet. In b), the coating is applied as a solution, the solvent being dried to leave a coherent coating. The substantially insoluble material can be applied to the tablet by, for example, spraying or dipping. Normally when the molten material is sprayed on to the tablet, it will rapidly solidify to form a coherent coating. When tablets are dipped into the molten material and then removed, the rapid cooling again causes rapid solidification of the coating material. Clearly substantially insoluble materials having a melting point below 40° C. are not sufficiently solid at ambient temperatures and it has been found that materials having a melting point above about 200° C. are not practicable to use. Preferably, the materials melt in the range from 60° C. to 160° C., more preferably from 70° C. to 120° C.

By "melting point" is meant the temperature at which the material when heated slowly in, for example, a capillary tube becomes a clear liquid.

A coating of any desired thickness can be applied according to the present invention. For most purposes, the coating forms from 1% to 10%, preferably from 1.5% to 5%, of the tablet weight.

The tablet coatings of the present invention are very hard and provide extra strength to the tablet.

In a preferred embodiment of the present invention the fracture of the coating in the wash is improved by adding a disintegrant in the coating. This disintegrant will swell once in contact with water and break the coating in small pieces. This will improve the dissolution of the coating in the wash solution. The disintegrant is suspended in the coating melt at a level of up to 30%, preferably between 5 and 20%, and most preferably between 5 and 10% by weight.

Possible disintegrants are described in Handbook of Pharmaceutical Excipients (1986). Examples of suitable disintegrants include starch: natural, modified or pregelatinized starch, sodium starch gluconate; gum: agar gum, guar gum, locust bean gum, karaya gum, pectin gum, tragacanth gum; croscarmylose Sodium, crospovidone, cellulose, carboxymethyl cellulose, algenic acid and its salts including sodium alginate, silicone dioxide, clay, polyvinylpyrrolidone, soy polysacharides, ion exchange resins and mixtures thereof.

Depending on the composition of the starting material, and the shape of the tablets, the used compaction force will be adjusted to not affect the strength (Diametral Fracture Stress), and the disintegration time in the washing machine. This process may be used to prepare homogenous or layered tablets of any size or shape.

Diametrical Fracture Stress (DFS) is a way to express the strength of a tablet, it is determined by the following equation:

$$= \frac{2F}{\mu Dt}$$

Where F is the maximum force (Newton) to cause tensile failure (fracture) measured by a VK 200 tablet hardness tester supplied by Van Kell industries, Inc. D is the diameter of the tablet, and t the thickness of the tablet. (Method Pharmaceutical Dosage Forms: Tablets Volume 2 Page 213 to 217).

The rate of disintegration of a detergent tablet can be determined in two ways:

a) In a "VAN KEL" Friabilator with "Vankel Type" drums.
   - Put 2 tablets with a known weight and D.F.S in the Friabilator drum.
   - Rotate the drum for 20 rotations.
   - Collect all product and remaining tablet pieces from the Friabilator drum, and screen it on 5 mm, and through 1.7 mm
   - Express as % residue on 5 mm and through 1.7 mm.
   - The higher the % of material through 1.7 mm the better the disintegration.

b) In a washing machine according to the following method
   - Take two tablets with a known weight and fracture stress, and put them at the bottom of a washing machine (i.e. a Bauknecht WA 950).
   - Put a 3 kg mixed load on top of the tablets.
   - Run a 30° C. short cycle (program 4) with city water.
   - Stop the cycle after 5 min and check the wash load for undissolved tablet pieces, collect and weigh them, and record the percent residue left.

In another preferred embodiment of the present invention the tablets further comprises an effervescent.

Effervescency as defined herein means the evolution of bubbles of gas from a liquid, as the result of a chemical reaction between a soluble acid source and an alkali metal carbonate, to produce carbon dioxide gas, i.e. $C_6H_8O_7 + 3NaHCO_3 \rightarrow Na_3C_6H_5O_7 + 3CO_2 \uparrow + 3H_2O$ Further examples of acid and carbonate sources and other effervescent systems may be found in: (Pharmaceutical Dosage Forms: Tablets Volume 1 Page 287 to 291)

An effervescent may be added to the tablet mix in addition to the detergent ingredients. The addition of this effervescent to the detergent tablet improves the disintegration time of the tablet. The amount will preferably be between 5 and 20% and most preferably between 10 and 20% by weight of the tablet. Preferably the effervescent should be added as an agglomerate of the different particles or as a compact, and not as separated particles.

Due to the gas created by the effervescency in the tablet, the tablet can have a higher D.F.S. and still have the same disintegration time as a tablet without effervescency.

When the D.F.S. of the tablet with effervescency is kept the same as a tablet without, the disintegration of the tablet with effervescency will be faster.

Detersive Surfactants

Nonlimiting examples of surfactants useful herein typically at levels from about 1% to about 55%, by weight, include the conventional $C_{11}$–$C_{18}$ alkyl benzene sulfonates ("LAS") and primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3\text{–}M^+)CH_3$ and $CH_3(CH_2)_y(CHOSO_3\text{–}M^+)CH_2CH_3$ where x and (y+1) are integers of at least about 7, preferably at least about 9, and M is a water-solubilizing cation, especially sodium, unsaturated sulfates such as oleyl sulfate, the $C_{10}$–$C_{18}$ alkyl alkoxy sulfates ("$AE_xS$"; especially EO 1-7 ethoxy sulfates), $C_{10}$–$C_{18}$ alkyl alkoxy carboxylates (especially the EO 1-5 ethoxycarboxylates), the $C_{10-18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the overall compositions. The $C_{10}$–$C_{18}$ N-alkyl polyhydroxy fatty acid arnides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Mixtures of anionic and nonionic surfactants are especially useful. Other conventional useful surfactants are listed in standard texts.

Builders

Detergent builders can optionally be included in the compositions herein to assist in controlling mineral hardness. Inorganic as well as organic builders can be used. Builders are typically used in fabric laundering compositions to assist in the removal of particulate soils.

The level of builder can vary widely depending upon the end use of the composition.

Inorganic or P-containing detergent builders include, but are not limited to, the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulphates, and aluminosilicates. However, non-phosphate builders are required in some locales. Importantly, the compositions herein function surprisingly well even in the presence of the so-called "weak" builders (as compared with phosphates) such as citrate, or in the so-called "underbuilt" situation that may occur with zeolite or layered silicate builders.

Examples of silicate builders are the alkali metal silicates, particularly those having a $SiO_2$: $Na_2O$ ratio in the range 1.6:1 to 3.2:1 and layered silicates, such as the layered sodium silicates described in U.S. Pat. No. 4,664,839, issued May 12, 1987 to H. P. Rieck. NaSKS-6 is the trademark for a crystalline layered silicate marketed by Hoechst (commonly abbreviated herein as "SKS-6"). Unlike zeolite builders, the Na SKS-6 silicate builder does not contain aluminum. NaSKS-6 has the delta-$Na_2SiO_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. As noted above, the delta-$Na_2SiO_5$ (NaSKS-6 form) is most preferred for use herein. Other silicates may also be useful such as for example magnesium silicate, which can serve as a crispening agent in granular formulations, as a stabilizing agent for oxygen bleaches, and as a component of suds control systems.

Examples of carbonate builders are the alkaline earth and alkali metal carbonates as disclosed in German Patent Application No. 2,321,001 published on Nov. 15, 1973.

Aluminosilicate builders are useful in the present invention. Aluminosilicate builders are of great importance in most currently marketed heavy duty granular detergent compositions, and can also be a significant builder ingredient in liquid detergent formulations. Aluminosilicate builders include those having the empirical formula:

$$M_z(zAlO_2)_y].xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al, issued Oct. 12, 1976. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na_{12}[(AlO_2)_{12}(SiO_2)_{12}].xH_2O$$

wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in Berg, U.S. Pat. No. 3,128.287, issued Apr. 7, 1964, and Lamberti et al, U.S. Pat. No. 3,635,830, issued Jan. 18, 1972. See also "TMS/TDS" builders of U.S. Pat. No. 4,663,071, issued to Bush et al, on May 5, 1987. Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Other useful detergency builders include the ether hydroxypolycarboxylates, copolymers of maleic anhydride with ethylene or vinyl methyl ether. 1,3,5-trihydroxy benzene-2,4,6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance for heavy duty liquid detergent formulations due to their availability from renewable resources and their biodegradability. Citrates can also be used in granular compositions, especially in combination with zeolite and/or layered silicate builders. Oxydisuccinates are also especially useful in such compositions and combinations.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Other suitable polycarboxylates are disclosed in U.S. Pat. No. 4,144,226, Crutchfield et al, issued Mar. 13, 1979 and in U.S. Pat. No. 3,308,067, Diehl, issued Mar. 7, 1967. See also Diehl U.S. Pat. No. 3,723,322.

Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

In situations where phosphorus-based builders can be used, and especially in the formulation of bars used for hand-laundering operations, the various alkali metal phosphates such as the well-known sodium tripolyphosphates, sodium pyrophosphate and sodium orthophosphate can be used. Phosphonate builders such as ethane-1-hydroxy-1,1-diphosphonate and other known phosphonates (see, for example, U.S. Pat. Nos. 3,159,581; 3,213,030; 3,422,021; 3,400,148 and 3,422,137) can also be used.

Bleach

The detergent compositions herein may optionally contain bleaching agents or bleaching compositions containing a bleaching agent and one or more bleach activators. When present, bleaching agents will typically be at levels of from about 1% to about 30%, more typically from about 5% to about 20%, of the detergent composition, especially for fabric laundering. If present, the amount of bleach activators will typically be from about 0.1% to about 60%, more typically from about 0.5% to about 40% of the bleaching composition comprising the bleaching agent-plus-bleach activator.

The bleaching agents used herein can be any of the bleaching agents useful for detergent compositions in textile cleaning, hard surface cleaning, or other cleaning purposes that are now known or become known. These include oxygen bleaches as well as other bleaching agents. Perborate bleaches, e.g., sodium perborate (e.g., mono- or tetrahydrate) can be used herein.

Another category of bleaching agent that can be used without restriction encompasses percarboxylic acid bleaching agents and salts thereof. Suitable examples of this class of agents include magnesium monoperoxyphthalate hexahydrate, the magnesium salt of metachloro perbenzoic acid, 4-nonylamino-4-oxoperoxybutyric acid and diperoxydodecanedioic acid. Such bleaching agents are disclosed in U.S. Pat. No. 4,483,781, Hartman, issued Nov. 20, 1984, U.S. patent application Ser. No. 740,446, Burns et al, filed Jun. 3, 1985, European Patent Application 0,133,354, Banks et al, published Feb. 20, 1985, and U.S. Pat. No. 4,412,934, Chung et al, issued Nov. 1, 1983. Highly preferred bleaching agents also include 6-nonylamino-6-oxoperoxycaproic acid as described in U.S. Pat. No. 4,634,551, issued Jan. 6, 1987 to Burns et al.

Peroxygen bleaching agents can also be used. Suitable peroxygen bleaching compounds include sodium carbonate peroxyhydrate and equivalent "percarbonate" bleaches, sodium pyrophosphate peroxyhydrate, urea peroxyhydrate, and sodium peroxide. Persulfate bleach (e.g., OXONE, manufactured commercially by DuPont) can also be used.

A preferred percarbonate bleach comprises dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Optionally, the percarbonate can be coated with silicate, borate or water-soluble surfactants. Percarbonate is available from various commercial sources such as FMC, Solvay and Tokai Denka.

Mixtures of Bleaching Agents Can Also Be Used

Peroxygen bleaching agents, the perborates, the percarbonates, etc., are preferably combined with bleach activators, which lead to the in situ production in aqueous solution (i.e., during the washing process) of the peroxy acid corresponding to the bleach activator. Various nonlimiting examples of activators are disclosed in U.S. Pat. No. 4,915,854, issued Apr. 10, 1990 to Mao et al, and U.S. Pat. No. 4,412,934. The nonanoyloxybenzene sulfonate (NOBS) and tetraacetyl ethylene diamine (TAED) activators are typical. and mixtures thereof can also be used. See also U.S. Pat. No. 4,634,551 for other typical bleaches and activators useful herein.

Highly preferred amido-derived bleach activators are those of the formulae:

$$R^1N(R^5)C(O)R^2C(O)L$$

or $$R^1C(O)N(R^5)R^2C(O)L$$

wherein $R^1$ is an alkyl group containing from about 6 to about 12 carbon atoms, $R^2$ is an alkylene containing from 1 to about 6 carbon atoms, $R^5$ is H or alkyl, aryl, or alkaryl containing from about 1 to about 10 carbon atoms, and L is any suitable leaving group. A leaving group is any group that is displaced from the bleach activator as a consequence of the nucleophilic attack on the bleach activator by the perhydrolysis anion. A preferred leaving group is phenyl sulfonate.

Preferred examples of bleach activators of the above formulae include (6-octanamido-caproyl) oxybenzenesulfonate, (6-nonanamidocaproyl) oxybenzenesulfonate, (6-decanamido-caproyl) oxybenzenesulfonate, and mixtures thereof as described in U.S. Pat. No. 4,634,551, incorporated herein by reference.

Another class of bleach activators comprises the benzoxazin-type activators disclosed by Hodge et al in U.S. Pat. No. 4,966,723, issued Oct. 30, 1990, incorporated herein by reference. A highly preferred activator of the benzoxazin-type is:

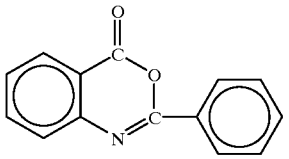

Still another class of preferred bleach activators includes the acyl lactam activators, especially acyl caprolactams and acyl valerolactams of the formulae:

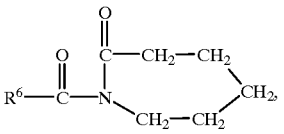

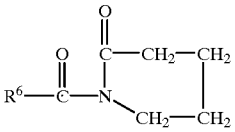

wherein $R^6$ is H or an alkyl, aryl, alkoxyaryl, or alkaryl group containing from 1 to about 12 carbon atoms. Highly preferred lactarn activators include benzoyl caprolactam, octanoyl caprolactam, 3,5,5-trimethylhexanoyl caprolactam, nonanoyl caprolactam, decanoyl caprolactam, undecenoyl caprolactam, benzoyl valerolactam, octanoyl valerolactam, decanoyl valerolactam, undecenoyl valerolactam, nonanoyl valerolactam, 3,5,5-trimethylhexanoyl valerolactam and mixtures thereof. See also U.S. Pat. No. 4,545,784, issued to Sanderson, Oct. 8, 1985, incorporated herein by reference, which discloses acyl caprolactams, including benzoyl caprolactam, adsorbed into sodium perborate.

Bleaching agents other than oxygen bleaching agents are also known in the art and can be utilized herein. One type of non-oxygen bleaching agent of particular interest includes photoactivated bleaching agents such as the sulfonated zinc and/or aluminum phthalocyanines. See U.S. Pat. No. 4,033,718, issued Jul. 5, 1977 to Holcombe et al. If used, detergent compositions will typically contain from about 0.025% to about 1.25%, by weight, of such bleaches, especially sulfonate zinc phthalocyanine.

If desired, the bleaching compounds can be catalyzed by means of a manganese compound. Such compounds are well known in the art and include, for example, the manganese-based catalysts disclosed in U.S. Pat. No. 5,246,621, U.S. Pat. No. 5,244,594; U.S. Pat. No. 5,194,416; U.S. Pat. No. 5,114,606; and European Pat. App. Pub. Nos. 549,271A1, 549,272A1, 544,440A2, and 544,490A1; Preferred examples of these catalysts include $Mn^{IV}_2(u\text{-}O)_3$(1,4,7-trimethyl-1,4,7-triazacyclononane)$_2(PF_6)_2$, $Mn^{III}_2(u\text{-}O)_1(u\text{-}OAc)_2$(1,4,7-trimethyl-1,4,7-triazacyclononane)$_2$-$(ClO_4)_2$, $Mn^{IV}_4(u\text{-}O)_6$(1,4,7-triazacyclononane)$_4(ClO_4)_4$, $Mn^{III}Mn^{IV}_4(u\text{-}O)_1(u\text{-}OAc)_2$-(1,4,7-trimethyl-1,4,7-triazacyclononane)$_2(ClO_4)_3$, $Mn^{IV}$(1,4,7-trimethyl-1,4,7-triazacyclononane)-$(OCH_3)_3(PF_6)$, and mixtures thereof. Other metal-based bleach catalysts include those disclosed in U.S. Pat. No. 4,430,243 and U.S. Pat. No. 5,114,611. The use of manganese with various complex ligands to enhance bleaching is also reported in the following U.S. Pat. Nos.: 4,728,455; 5,284,944; 5,246,612; 5,256,779; 5,280,117; 5,274,147; 5,153,161; and 5,227,084.

As a practical matter, and not by way of limitation, the compositions and processes herein can be adjusted to provide on the order of at least one part per ten million of the active bleach catalyst species in the aqueous washing liquor, and will preferably provide from about 0.1 ppm to about 700 ppm, more preferably from about 1 ppm to about 500 ppm, of the catalyst species in the laundry liquor.

Enzymes

Enzymes can be included in the formulations herein for a wide variety of fabric laundering purposes, including removal of protein-based, carbohydrate-based, or triglyceride-based stains, for example, and for the prevention of refugee dye transfer, and for fabric restoration. The enzymes to be incorporated include proteases, amylases, lipases, cellulases, and peroxidases, as well as mixtures thereof. Other types of enzymes may also be included. They may be of any suitable origin, such as vegetable, animal, bacterial, fungal and yeast origin. However, their choice is governed by several factors such as pH-activity and/or stability optima, thermostability, stability versus active detergents, builders and so on. In this respect bacterial or fungal enzymes are preferred, such as bacterial amylases and proteases, and fungal cellulases.

Enzymes are normally incorporated at levels sufficient to provide up to about 5 mg by weight, more typically about 0.01 mg to about 3 mg, of active enzyme per gram of the composition. Stated otherwise, the compositions herein will typically comprise from about 0.001% to about 5%, preferably 0.01%–1% by weight of a commercial enzyme preparation. Protease enzymes are usually present in such commercial preparations at levels sufficient to provide from 0.005 to 0.1 Anson units (AU) of activity per gram of composition.

Suitable examples of proteases are the subtilisins which are obtained from particular strains of *B. subtilis* and *B. licheniforms*. Another suitable protease is obtained from a strain of Bacillus, having maximum activity throughout the pH range of 8–12, developed and sold by Novo Industries A/S under the registered trade name ESPERASE. The preparation of this enzyme and analogous enzymes is described in British Patent Specification No. 1,243,784 of Novo. Proteolytic enzymes suitable for removing protein-based stains that are commercially available include those sold under the tradenames ALCALASE and SAVINASE by Novo Industries A/S (Denmark) and MAXATASE by International Bio-Synthetics, Inc. (The Netherlands). Other proteases include Protease A (see European Patent Application 130,756, published Jan. 9, 1985) and Protease B (see European Patent Application Serial No. 87303761.8, filed Apr. 28, 1987, and European Patent Application 130,756, Bott et al, published Jan. 9, 1985).

Amylases include, for example, (x-amylases described in British Patent Specification No. 1,296,839 (Novo), RAPIDASE, International Bio-Synthetics, Inc. and TERMAMYL, Novo Industries.

The cellulase usable in the present invention include both bacterial or fungal cellulase. Preferably, they will have a pH optimum of between 5 and 9.5. Suitable cellulases are disclosed in U.S. Pat. No. 4,435,307, Barbesgoard et al, issued Mar. 6, 1984, which discloses fungal cellulase produced from Humicola insolens and Humicola strain DSM1800 or a cellulase 212-producing fungus belonging to the genus Aeromonas, and cellulase extracted from the hepatopancreas of a marine mollusk (Dolabella Auricula Solander). Suitable cellulases are also disclosed in GB-A-2.075.028; GB-A-2.095.275 and DE-OS-2.247.832. CAREZYME (Novo) is especially useful.

Suitable lipase enzymes for detergent usage include those produced by microorganisms of the Pseudomonas group, such as *Pseudomonas stutzeri* ATCC 19.154, as disclosed in British Patent 1,372,034. See also lipases in Japanese Patent Application 53,20487, laid open to public inspection on Feb. 24, 1978. This lipase is available from Amano Pharmaceutical Co. Ltd., Nagoya, Japan, under the trade name Lipase P "Amano," hereinafter referred to as "Amano-P." Other commercial lipases include Amano-CES, lipases ex Chromobacter viscosum, e.g. Chromobacter viscosum var. lipolyticum NRRLB 3673, commercially available from Toyo Jozo Co., Tagata, Japan; and further Chromobacter viscosum lipases from U.S. Biochemical Corp., U.S.A. and Disoynth Co., The Netherlands, and lipases ex *Pseudomonas gladioli*. The LIPOLASE enzyme derived from *Humicola lanuginosa* and commercially available from Novo (see also EPO 341,947) is a preferred lipase for use herein.

Peroxidase enzymes are used in combination with oxygen sources, e.g., percarbonate, perborate, persulfate, hydrogen peroxide, etc. They are used for "solution bleaching," i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813, published Oct. 19, 1989, by O. Kirk, assigned to Novo Industries A/S.

A wide range of enzyme materials and means for their incorporation into synthetic detergent compositions are also disclosed in U.S. Pat. No. 3,553,139, issued Jan. 5, 1971 to McCarty et al. Enzymes are further disclosed in U.S. Pat. No. 4,101,457, Place et al, issued Jul. 18, 1978, and in U.S. Pat. No. 4,507,219, Hughes, issued Mar. 26, 1985, both. Enzyme materials useful for liquid detergent formulations, and their incorporation into such formulations, are disclosed in U.S. Pat. No. 4,261,868, Hora et al, issued Apr. 14, 1981. Enzymes for use in detergents can be stabilized by various techniques. Enzyme stabilization techniques are disclosed and exemplified in U.S. Pat. No. 3,600,319, issued Aug. 17, 1971 to Gedge, et al, and European Patent Application Publication No. 0 199 405, Application No. 86200586.5, published Oct. 29, 1986, Venegas. Enzyme stabilization systems are also described, for example, in U.S. Pat. No. 3,519,570.

Other components which are commonly used in detergent compositions and which may be incorporated into the detergent tablets of the present invention include chelating agents, soil release agents, soil antiredeposition agents, dispersing agents, brighteners, suds suppressors, fabric softeners, dye transfer inhibition agents and perfumes.

EXAMPLES

| | Ex. 1 | Ex. 2 |
|---|---|---|
| Anionic Agglomerates | 25.00 | 20.00 |
| Nonionic Agglomerate | 5.53 | 4.42 |
| Bleach Activator Agglomerates | 5.69 | 4.55 |
| Zinc Phthalocyanine sulphonate encapsulate | 0.03 | 0.02 |
| Suds Supressor | 3.23 | 2.58 |
| Dried Zeolite | 6.30 | 5.04 |
| Layered Silicate | 13.69 | 10.95 |
| Dye transfer Inhibitor Agglomerate | 0.13 | 0.10 |
| Perfume Encapsulates | 0.23 | 0.18 |
| Nonionic Paste Spray-on | 5.43 | 4.34 |
| Fluorescer | 0.26 | 0.21 |
| Sodium carbonate | 4.68 | 3.74 |
| Sodium percarbonate | 19.78 | 15.86 |
| Sodium HEDP | 0.79 | 0.63 |
| Soil Release polymer | 0.18 | 0.14 |
| Perfume | 0.33 | 0.26 |
| Protease | 0.86 | 0.69 |
| Cellulase | 0.25 | 0.20 |
| Lipase | 0.21 | 0.17 |
| Amylase | 0.70 | 0.56 |
| Adipic Acid | 6.70 | 6.70 |
| Effervescency Compact | — | 18.66 |
| TOTAL | 100.00 | 100.00 |

Anionic agglomerates comprise 38% anionic surfactant, 22% zeolite and 40% carbonate.

Nonionic agglomerates comprise 26% nonionic surfactant, 48% zeolite and 26% carbonate.

Bleach activator agglomerates comprise 81% TAED, 17% acrylic/maleic copolymer (acid form) and 2% water.

Zinc Phthalocyanine sulphonate encapsulates are 10% active.

Suds suppressor comprises 11.5% silicone oil (ex Dow Coming), and 88.5% starch.

Layered silicate comprises 78% SKS-6, ex Hoechst, 22% citric acid.

Dye transfer inhibitor agglomerates comprise 21% PVNO/PVPVI, 61% zeolite and 18% carbonate.

Perfuime encapsulates comprise 50% perfume and 50% starch.

Nonionic paste spray-on comprises 67% C12–C15 AES (alcohol with an average of 5 ethoxy groups per molecule), 24% N-methyl glucose amide and 9% water.

Effervescent compact comprises 54.5% sodium bicarbonate and 45.5% citric acid.

All the particulate materials of Example 1, except for the dried zeolite, were mixed together in a mixing drum to form a homogeneous particulate mixture, during this mixing the spray-ons were carried out. After the spray-ons the dusting was carried out with the dried zeolite.

A first series of tablets were made the following way, about 37.5 g. of the mixture was introduced into a mould of circular shape with a diameter of 4.5 cm, and compressed with a force of 0.5 kN. or about 30 Newton/$cm^2$, to give tablets of about 2.2 cm height and a density of about 1.1 g./cc. The tensile strength of the tablet was 3.5 kPa.

Adipic acid was heated in a thermostatic bath till 170° C. with gentle stirring until molten. The molten product was clear liquid. The tablets prepared as above were then dipped into the liquid to give the final coated tablet, this tablet had a total weight of 40.2 g, and a tensile strength of 6.5 kPa.

An second series of tablets was made with a compaction force of 1 kN. or about 63 N/$cm^2$ to give tablets of about 2.0 cm height, a density of about 1.2 g./cc, and a tensile strength of 9.0 kPa.

After coating with Adipic Acid the tablets had a weight of 40.2 g, and the tensile strength was 15.5 kPa.

A third series of tablets was made with a compaction force of 1.5 kN. or about 95N/$cm^2$ to give tablets of about 1.9 cm height, a density of about 1.3 g./cc, and a tensile strength of 12.9 kPa.

After coating with Adipic Acid the tablets had a weight of 40.2 g, and the tensile strength was 19.5 kPa.

Example 2

Mixing according to the method described in Example 1, after the dusting the effervescency granules were added to the mix drum, and a final mix was made.

Tabletting and coating was carried out according to the method described in Example 1.

A first series of tablets was made with a Compaction Force of 1 kN. or about 63 Newton/$cm^2$, to give tablets of about 2.2 cm height, a density of about 1.1 gr./cc, and a tensile strength of 4.5 kPa.

After coating with Adipic acid the tablets had a weight of 40.2 g, and the tensile strength was 10.4 kPa.

A second series of tablets was made with a compaction force of 1.5 kN. or about 95 N/$cm^2$ to give tablets of about 2.1 cm height, a density of about 1.2 gr./cc, and a tensile strength of 8.5 kPa.

After coating with Adipic Acid the tablets had a weight of 40.2 g, and a tensile strength was 14.5 kPa.

An third series of tablets was made with a compaction force of 2.5 kN. or about 160 N/$cm^2$ to give tablets of about 2.0 cm height, a density of about 1.2 g./cc, and a tensile strength of 15.7 kPa.

After coating with Adipic Acid the tablets had a weight of 40.2 g, and the tensile strength increased to 21.3 kPa.

Example 1 was repeated replacing the adipic acid by glutaric acid. The glutaric acid was heated in a thermostatic bath to 120° C. with gentle stirring until molten. The final tensile strength of the three series of tablets was 10.4 kPa, 17.3 kPa and 22.5 kPa respectively.

Example 2 was repeated replacing the adipic acid by glutaric acid. The glutaric acid was heated in a thermostatic bath to 120° C. with gentle stirring until molten. The final tensile strength of the three series of tablets was 11.3 kPa, 16.9 kPa and 23.0 kPa respectively.

Similar results were obtained by replacing the adipic acid of examples 1 or 2 with any one of: azelaic acid, suberic acid or sebacic acid.

What is claimed is:

1. A tablet comprising a core and a coating, the core being formed by compressing a particulate material, the particulate material comprising surfactant and detergent builder, wherein the coating comprises dicarboxylic acid, said tablet further comprising:

i) a water-swellable disintegrant present in said coating; or ii) an effervescent present in said core; or iii) a combination of (i) and (ii).

2. A tablet according to claim 1 wherein the length of the carbon chain of the dicarboxylic acid is from $C_2$ to $C_{13}$.

3. A tablet according to claim 1 wherein the coating consists essentially of dicarboxylic acid and a water-swellable disintegrant.

4. A process for making a tablet according to claim 1, comprising the steps of:

(a) forming a core by compressing a particulate material, the particulate material comprising surfactant and detergent builder;

(b) applying a coating material to the core, the coating material being in the form of a melt;

(c) allowing the molten coating material to solidify;

characterized in that the coating material comprises dicarboxylic acid and optionally, a water-swellable disintegrant.

5. A process according to claim 4 wherein the coating material has a melting point of from 40° C. to 200° C.

6. A process for making a tablet according to claim 1, comprising the steps of:

(a) forming a core by compressing a particulate material, the particulate material comprising surfactant and detergent builder;

(b) applying a coating material to the core, the coating material being dissolved in a solvent or water;

(c) allowing the solvent or water to evaporate;

characterized in that the coating material comprises dicarboxylic acid and optionally, a water-swellable disintegrant.

* * * * *